US006177876B1

(12) United States Patent
Krueger

(10) Patent No.: US 6,177,876 B1
(45) Date of Patent: Jan. 23, 2001

(54) PRESSURE SENSITIVE ALARM COMPONENT

(76) Inventor: Stephen Krueger, 956-47 Lupine Hills Dr., Vista, CA (US) 92083

( * ) Notice: Under 35 U.S.C. 154(b), the term of this patent shall be extended for 0 days.

(21) Appl. No.: 09/274,283

(22) Filed: Mar. 22, 1999

(51) Int. Cl.[7] ..... G08B 21/00

(52) U.S. Cl. ..... 340/666; 340/568.1; 340/568.8; 340/668; 200/85 R

(58) Field of Search ..... 340/666, 568.1, 340/693, 568.8, 568.2, 568.3, 568.6, 571, 572.1, 572.3, 668; 200/85 R; 307/119, 139

(56) References Cited

U.S. PATENT DOCUMENTS

| | | | | |
|---|---|---|---|---|
| 2,973,414 | | 2/1961 | Bossemeyer | 200/56 |
| 3,056,865 | | 10/1962 | Readron et al. | 200/56 |
| 3,685,037 | | 8/1972 | Bennett et al. | 340/280 |
| 3,778,808 | | 12/1973 | Stevens | 340/282 |
| 4,274,088 | | 6/1981 | Pierson et al. | 340/568 |
| 4,716,401 | | 12/1987 | Wohlford et al. | 340/568 |
| 4,994,793 | | 2/1991 | Curtis | 340/666 |
| 5,041,815 | | 8/1991 | Newton | 340/568 |
| 5,159,316 | | 10/1992 | Lazzara | 340/568 |
| 5,196,827 | | 3/1993 | Allen et al. | 340/568 |
| 5,325,325 | * | 6/1994 | McCaughan, Jr. | 340/666 |
| 5,764,153 | * | 6/1998 | Vedaa | 340/666 |
| 5,796,059 | * | 8/1998 | Boon | 200/85 R |
| 5,990,799 | * | 11/1999 | Boon et al. | 340/667 |

* cited by examiner

*Primary Examiner*—Edward Lefkowitz
*Assistant Examiner*—Davetta Goins
(74) *Attorney, Agent, or Firm*—Gary L. Eastman

(57) ABSTRACT

A Pressure Sensitive Alarm Component is provided and includes a pressure plate and a base plate. Within the base plate are the pressure plate truss assemblies, the weight transfer assembly, and the sliding switch assembly. The weight transfer assembly includes a load transfer arm which moves back and forth as weight is placed on or removed from the pressure plate and a dial to adjust the position of the load transfer arm. The sliding switch assembly includes a sliding contact support arm which is rigidly linked to the load transfer arm. The sliding switch assembly further includes a plurality of stationary contacts incorporated into a base plate, and two sliding contacts mounted on the sliding contact support arm. The sliding contacts may move along the stationary contacts and open and close the control circuit as they come in out of contact with different pairs of stationary contacts. Once an object is place on the pressure, if the sliding contacts are not in contact with a pair of stationary contacts, the sliding contacts may be repositioned to bring them into contact with a pair of stationary contacts by turning the dial to move the load transfer arm and the sliding contact support arm. Once contact is made, an LED will light up and the alarm may be activated. If the object is thereafter removed, the alarm will sound.

20 Claims, 8 Drawing Sheets

PRESSURE SENSITIVE ALARM COMPONENT

FIELD OF THE INVENTION

The present invention relates generally to alarm components. More specifically, the present invention pertains to alarm components which are object specific. The present invention is particularly, though not exclusively, useful as a means by which valuables may be stacked on an alarm component, and if any, or all, of these valuables are removed, an alarm will sound.

BACKGROUND OF THE INVENTION

For centuries, theft and burglary have plagued homeowners and business people. Sophisticated electronic equipment, such as motion detectors, door and window alarms, and video cameras, may be purchased and installed in a person's home or business to protect against the theft of valuable goods. This equipment is typically very expensive, but it is not fool proof. For example, video cameras cannot monitor every nook and cranny of a warehouse or storage room and video tapes may be stolen. Additionally, motion detectors, window alarms and door alarms must be turned off during a business' hours of operation.

As a result, many object specific alarm components have been invented.

U.S. Pat. No. 5,196,827, which issued in 1993 to Allen et al. for an invention entitled "Alarm Apparatus For Handgun Security" (the "'827 patent"), discloses an alarm component for detecting the removal of a handgun from a plate where the handgun is kept for quick accessibility.

The device of the '827 patent includes one or more force sensors which are embedded between an upper plate and a lower plate. After placing a handgun on the upper plate, the owner must adjust two variable resistors to define a zone which encompasses the force exerted by the mass of the handgun. When the handgun is removed, the alarm is sounded. This alarm component is effective, but includes excessive electronics and is difficult to adjust to account for handguns of different weights. Moreover, the '827 patent is unable to account for incremental shifts in weight.

U.S. Pat. No. 5,159,316, which issued in 1992 to Lazzara for an invention entitled "Capacitance Change Article Removal Alarm" (the "'316 patent"), discloses an alarm component For detecting the removal of an object from a location where the object is to be protected. The device of the '316 patent includes a compressible detection pad composed of an upper conducting plate, a lower conducting plate, and a dielectric layer separating these plates.

When an object is placed on the compressible detection pad of the '316 patent, a portion of the dielectric layer is compressed and the alarm is set. When the object is removed from the device of the '316 patent, the dielectric layer expands and the capacitance between the two conducting plates changes. The alarm circuitry detects this change in capacitance and an alarm is sounded. Unfortunately, the device of the '316 patent may be easily defeated. Additionally, the '316 patent includes excessive electronics, but may not account for incremental shifts in weight.

U.S. Pat. No. 4,274,088, which issued in 1981 to Pierson et al. for an invention entitled "Portable Alarm System" (the "'088 patent"), discloses an alarm component for detecting the removal of an object, such as a sculpture, from a pedestal where it is kept for display purposes. The device of the '088 patent includes an alarm system having a base member with a top spring-loaded plunger extending from the upper surface of the base member and a bottom spring-loaded plunger extending from the lower surface of the base member. The bottom plunger is depressed by placing the base member on a table or pedestal and the top plunger is depressed by placing an object on top of the base member over the top plunger.

If the protected object is removed from the base member of the '088 patent or the base member is removed from the table or pedestal, an alarm is triggered. This alarm component is effective, but not fool-proof. The plunger switches may be defeated by slipping a thin object between the top-plunger and the protected object or the bottom plunger and the table or pedestal. Additionally, the '088 patent does not include a means for adjusting the spring-loaded plungers to account for objects with different weight. The '088 patent also does not include a means which would account for incremental shifts in weight.

Accordingly, it is the object of the present invention to provide an alarm component which may be used to protect specific valuables from being stolen. It is another object of the present invention to provide an alarm component which may be easily adjusted to account for objects of different weights. It is another object of the present invention to provide an alarm component which may be adjusted to account for incremental shifts in weight. It is another object of the present invention to provide an alarm component which may not be easily defeated. It is another object of the present invention to provide an alarm component which may be easily incorporated into existing alarm systems. It is yet another object of the present invention to provide an alarm component which is relatively easy to manufacture, relatively easy to install, and is comparatively cost effective.

SUMMARY OF THE INVENTION

In accordance with the present invention, a Pressure Sensitive Alarm Component is provided and includes a pressure plate and a base plate. Within the base plate are the pressure plate truss assemblies, the weight transfer assembly, and the sliding switch assembly. The truss assemblies support the pressure plate and if an object to be protected is placed on the pressure plate, the weight of that object is transferred to the sliding switch assembly via the pressure plate truss assemblies and the weight transfer assembly.

The weight transfer assembly includes a load transfer arm which moves back and forth as weight is placed on or removed from the pressure plate and a dial to adjust the position of the load transfer arm. The sliding switch assembly includes a sliding contact support arm which is rigidly linked to the load transfer arm. As the load transfer arm moves, so does the sliding contact support arm.

The sliding switch assembly further includes a plurality of stationary contacts incorporated into a base plate, and two sliding contacts mounted on the sliding contact support arm. The sliding contacts may move along the stationary contacts and open and close the control circuit as they come in out of contact with different pairs of stationary contacts.

Once an object is placed on the pressure plate, the sliding contacts may or may not be in contact with a pair of stationary contacts. If the sliding contacts are not in contact with a pair of stationary contacts once the object is placed on the pressure plate, the sliding contacts may be repositioned to bring them into contact with a pair of stationary contacts by turning the dial to move the load transfer arm and the sliding contact support arm. Once contact is made, an LED will light up and the alarm may be activated.

If the object is removed from the pressure plate after the alarm is activated, the sliding contacts will move and the control circuit will be opened sounding the alarm. If a stack of valuables are placed on the pressure plate in boxes and then removed on at a time, the pressure sensitive alarm component of the present invention can be easily adjusted to reflect this incremental reduction in weight by rotating the dial to reposition the sliding contacts along the stationary contacts incorporated into the base plate.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF A PREFERRED EMBODIMENT

Figure 1:
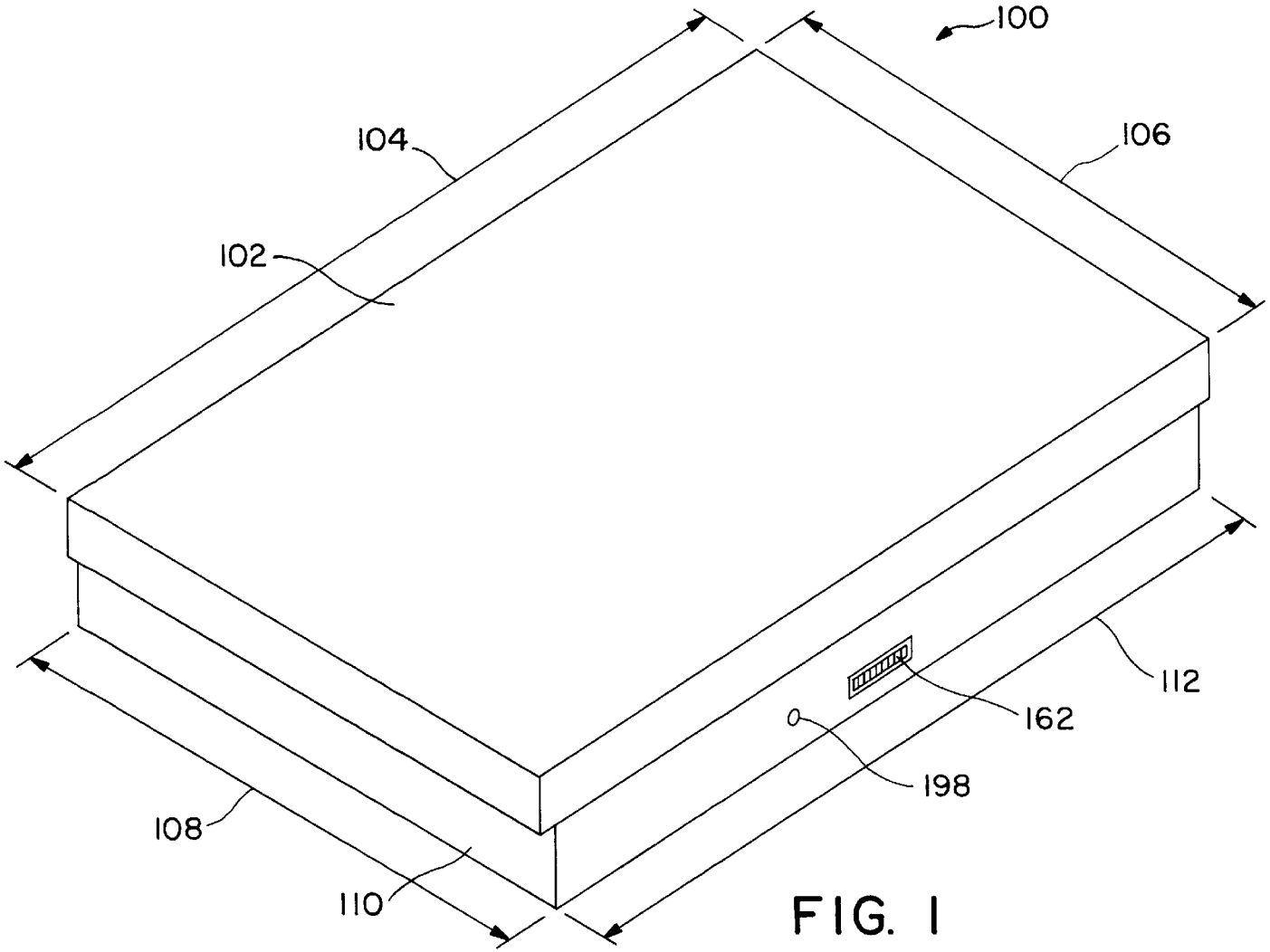
FIG. 1 is a perspective view of the Pressure Sensitive Alarm Component of the present invention.

Referring initially to FIG. 1 for an overview, a Pressure Sensitive Alarm Component is shown and generally designated 100. The Pressure Sensitive Alarm Component 100 includes a pressure plate 102, having a length 104 and a width 106, and a base plate 110, also having a length 112 and a width 114. The length 104 and width 106 of the pressure plate 102 may be slightly larger than the length 112 and width 114 of the base plate 110. This allows the pressure plate 102 to easily fit over the base plate 110 and slide up and down as a load is added to or removed from the pressure plate 102. The length 104 and width 106 of the pressure plate 102 may vary according to the objects to be placed on top of the Pressure Sensitive Alarm Component 100.

Figure 2:
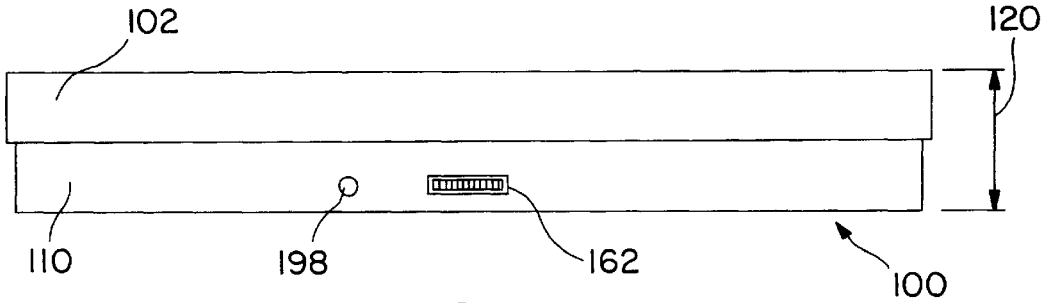
FIG. 2 is a front plan view of the Pressure Sensitive Alarm Component of the present invention.

FIG. 2 shows the Pressure Sensitive Alarm Component 100 with an overall height 120. The height 120 of the Pressure Sensitive Alarm Component 100 may be large enough to allow sufficient space to house the interior components, but small enough that the Pressure Sensitive Alarm Component 100 is not too bulky or intrusive when installed.

Figure 3:
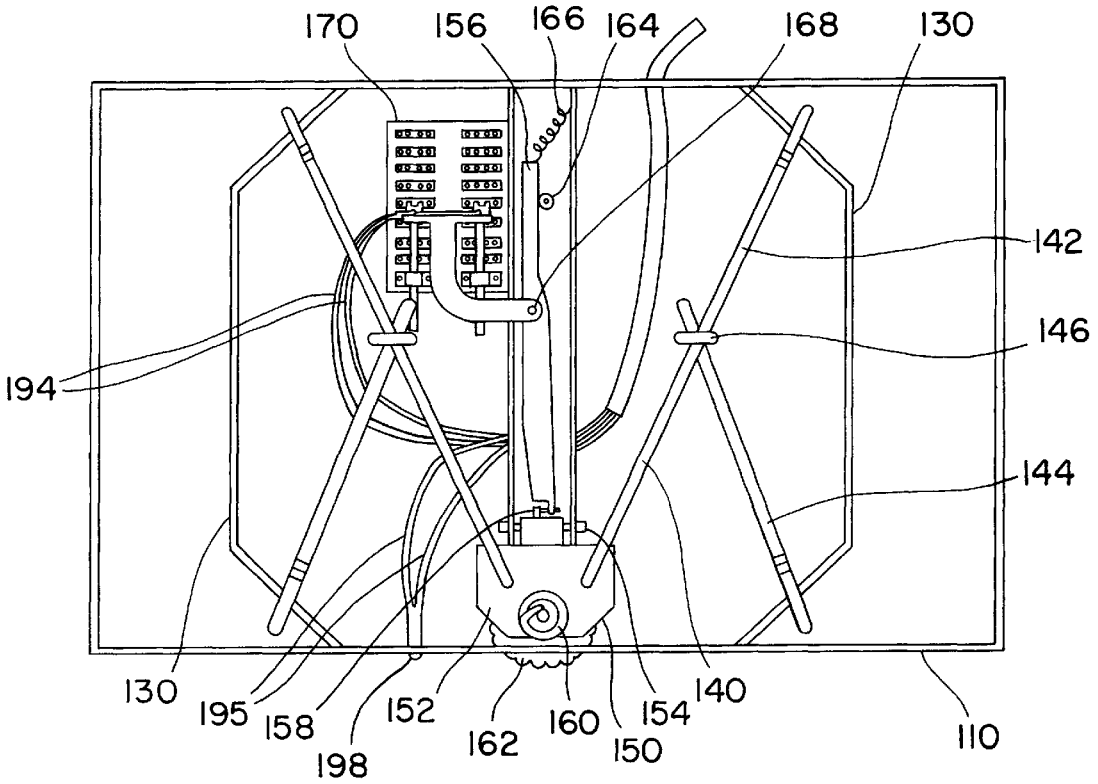
FIG. 3 is a top plan view of the Pressure Sensitive Alarm Component of the present invention with the pressure plate removed to reveal the interior components located within the base plate.

Referring now to FIG. 3, the Pressure Sensitive Alarm Component 100 is shown with the pressure plate 102 removed to reveal the interior of the base plate 110. The base plate 110 includes two interior walls 130 which support the pressure plate truss assemblies 140. Each pressure plate truss assembly 140 includes a longitudinal support member 142, a lateral support member 144 and a ring 146 which connects the lateral support member 144 to the longitudinal support member 142.

FIG. 3 also shows the weight transfer assembly 150 within the base plate 110. The weight transfer assembly 150 includes a load plate 152 which pivots about pin 154 and connects to the load transfer arm 156 at pin 158. The pressure plate truss assemblies 140 are affixed to the top of the load plate 152. When an object is placed on the pressure plate 102, the pressure plate truss assemblies 140 will transfer the weight of the object to the load plate 152. The load plate 152 will pivot about pin 158 and cause the load transfer arm 156 to move. To keep the load transfer arm 156 moving in a straight line, it is held in contact with a guide wheel 164 by a spring 166.

A spring 160 is included in the weight transfer assembly 150 to counteract any load placed on the pressure plate 102. The height of the load plate 152, and hence the location of the load transfer arm 156 may be adjusted by turning the dial 162 which includes a threaded post (not shown) which causes the load plate 152 to move up or down when the dial 162 is turned. By adjusting the load plate 152 down or up, the load transfer arm 156 may be moved back and forth.

Figure 4:
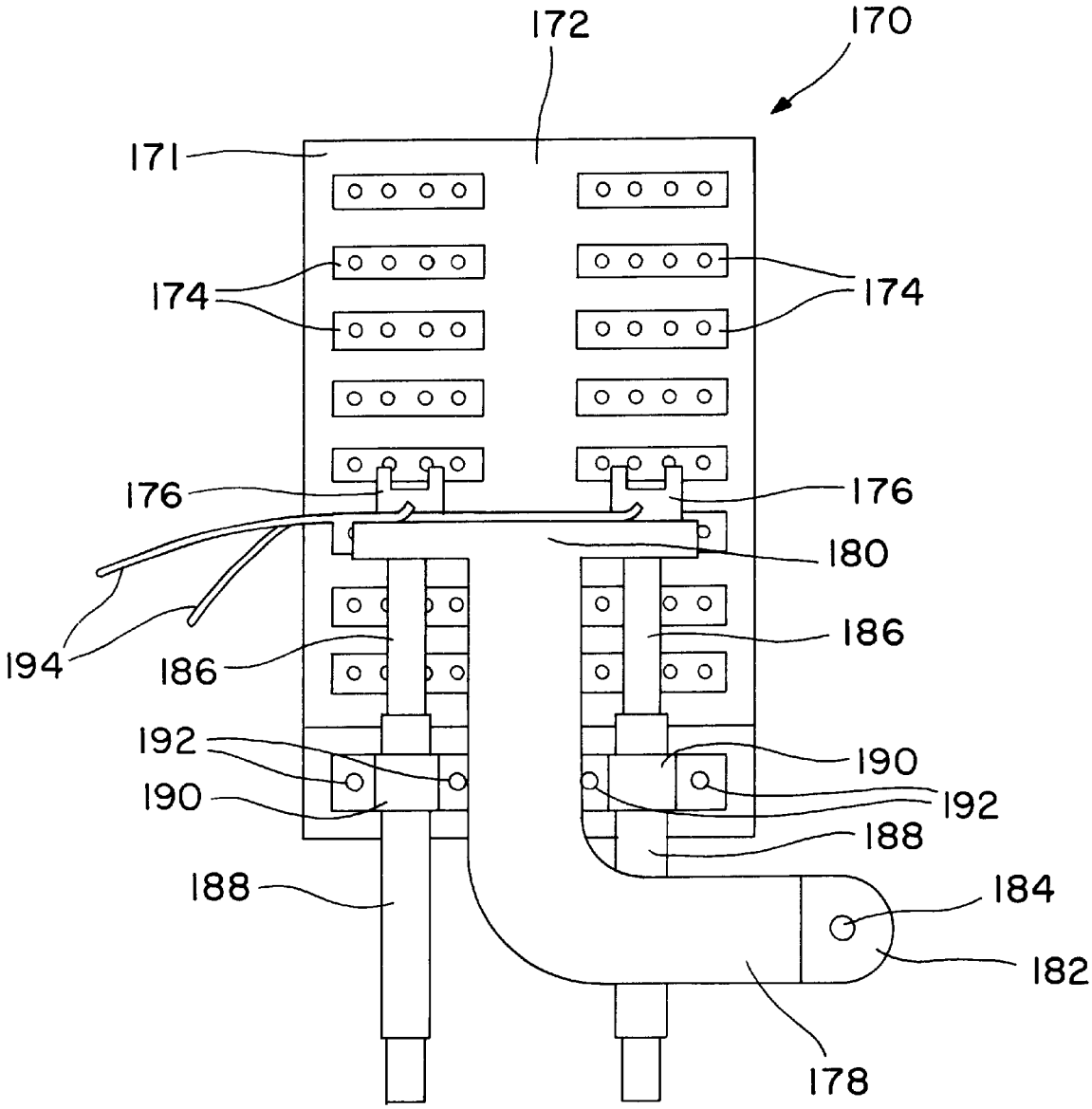
FIG. 4 is a top plan view of the sliding switch assembly removed from the base plate.

FIG. 3 shows the sliding switch assembly 170 connected to the load transfer arm 156 by a fastener 168. FIG. 4 is a detailed drawing showing the sliding switch assembly 170 with a circuit board 172, having a front 171 and back 173, a plurality of stationary contacts 174, and two sliding contacts 176 held by the sliding contact support arm 178. The sliding contact support arm 178 has a distal end 180 and a proximal end 182 formed with a hole 184. The sliding contacts 176 are attached to the distal end 180 of the sliding contact support arm 178.

The motion of the sliding contact support arm 178 may be restricted by the guide rails 186 which are fitted into the guide sleeves 188 and aligned with the motion of the load transfer arm 156. The guide sleeves 188 may be held in place by the mounting blocks 190 which may be attached to the circuit board 172 with several fasteners 192. As the load transfer arm 156 is pushed back and forth by the load plate 152, the sliding contact support arm 178 will move in unison with it.

Referring back to FIG. 3, two control wires 194 are shown extending from the sliding contacts 176. As the sliding contact support arm 178 moves, the sliding contacts 176 will slide along the circuit board 172 and may simultaneously contact two stationary contacts 174. When the sliding contacts 176 touch two of the stationary contacts 174, the circuit created by the control wires 194 will be closed.

FIG. 3 also shows a visible status indicator 198 with two control wires 195 extending from it. These wires may be placed in a series electrical connection with the sliding contacts 176 in order to provide a visible status indicator of the positions of the sliding contacts 176 either on or between stationary contacts 174. In this manner, the user of the present invention may load the load plate 102 with the desired merchandise, and then may adjust the dial 162 until the visible indicator 198 indicates either a short or open circuit, whichever is necessary for the alarm system being used. Then, if the desired merchandise is removed from the load plate, the electrical contacts will move, either opening a closed circuit or closing an open circuit. In a preferred embodiment, the visual status indicator may be a light emitting diode (LED) but it is to be appreciated that virtually any visible indicator may be used.

Alternatively, visible status indicator 198 may be replaced with an audible indicator, such as a piezoelectric alarm which would audibly alert that merchandise was removed from the load plate 102.

Figure 5:
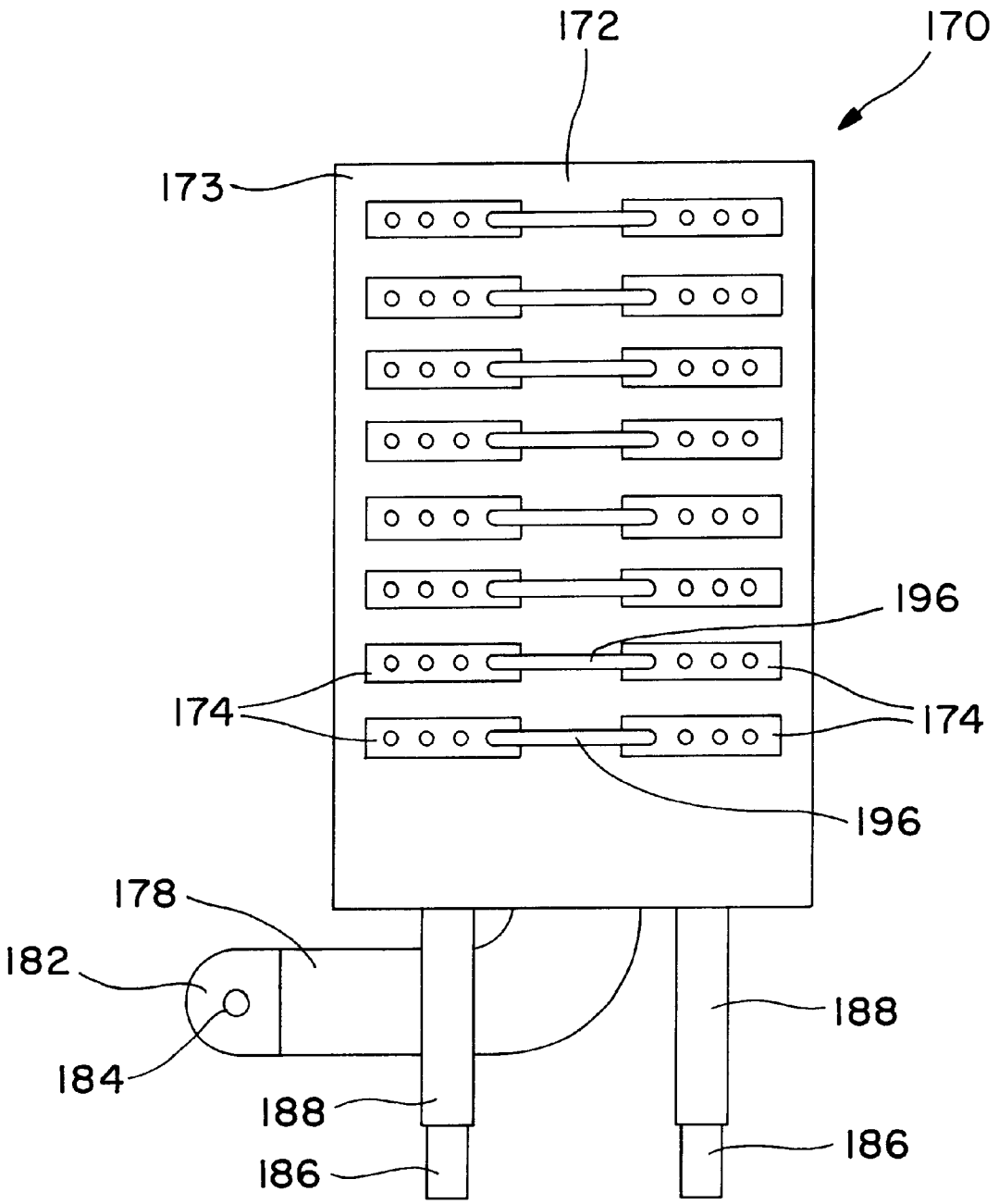
FIG. 5 is a bottom plan view of the sliding switch assembly removed from the base plate.

FIG. 5 shows the back 173 of the circuit board 172. The plurality of stationary contacts 174 are connected in pairs with a wire 196. This allows the sliding contacts 176 to close the circuit created by the control wires 194 when the sliding contacts 176 touch each pair of stationary contacts 174 on the front 174 of the base plate.

Figure 6:
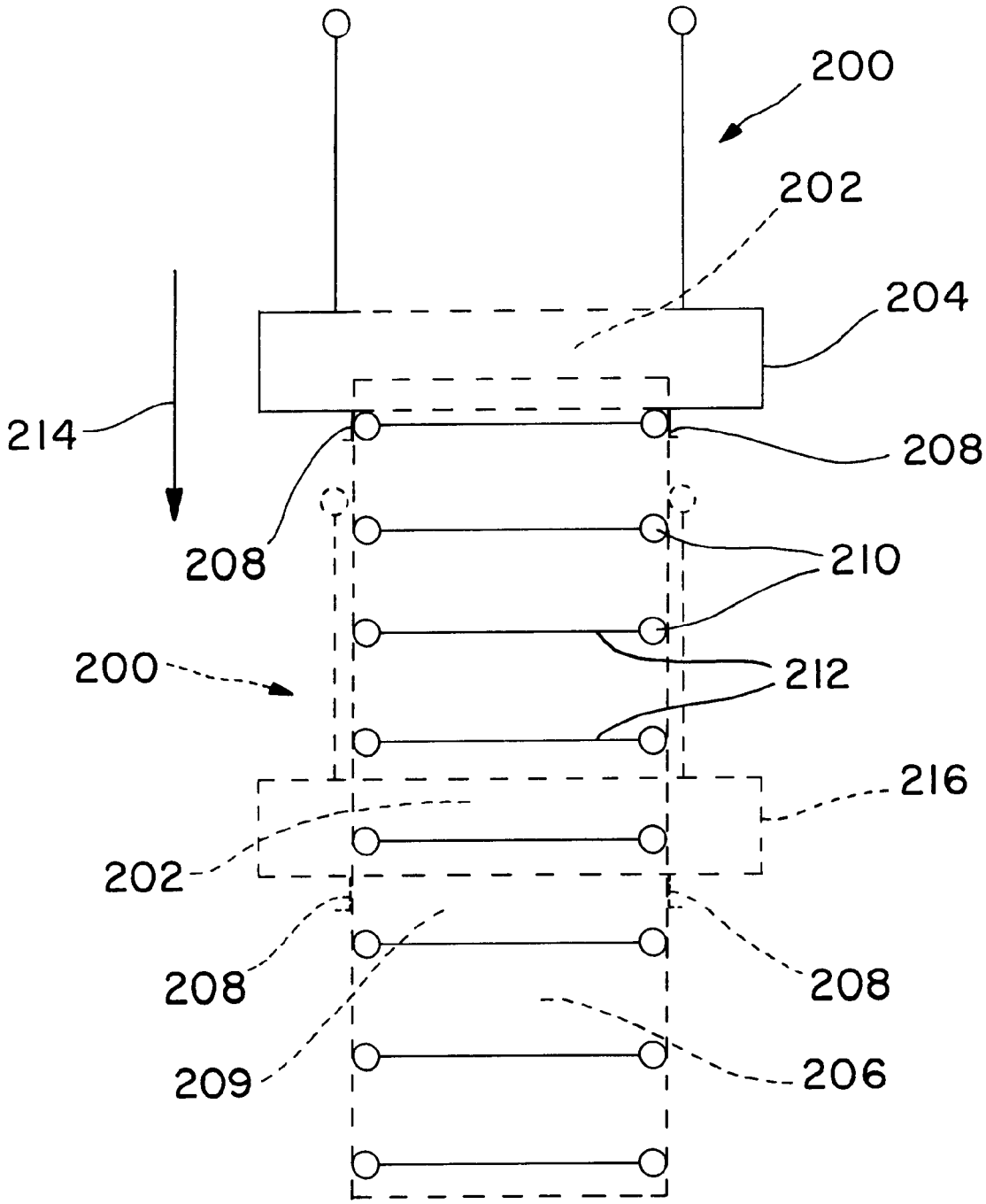
FIG. 6 is an electrical diagram representing the sliding switch assembly.

FIG. 6 is an electrical diagram showing the circuit created by the sliding switch assembly 170 shown in FIGS. 4 and 5. This circuit is generally designated 200. When the sliding contact support arm 202 is in the first position 204 with respect to the base plate 206, the sliding contacts 208 will be in contact with a pair of stationary contacts 210, which are connected by the wire 212, and the circuit 200 will be closed.

As the sliding contact support arm 202 moves in direction 214, along the base plate 206, the sliding contacts 208 may pass into gap 209 and lose contact with one pair of stationary contacts 210 and may then regain contact with another pair of stationary contacts 210 once it has passed through gap 209. On the other hand, the sliding contacts 208 may come to rest in the second position 216 in gap 209 where the sliding contacts 208 are not touching any stationary contacts 210, and thus, the circuit 200 will be open.

Figure 7:
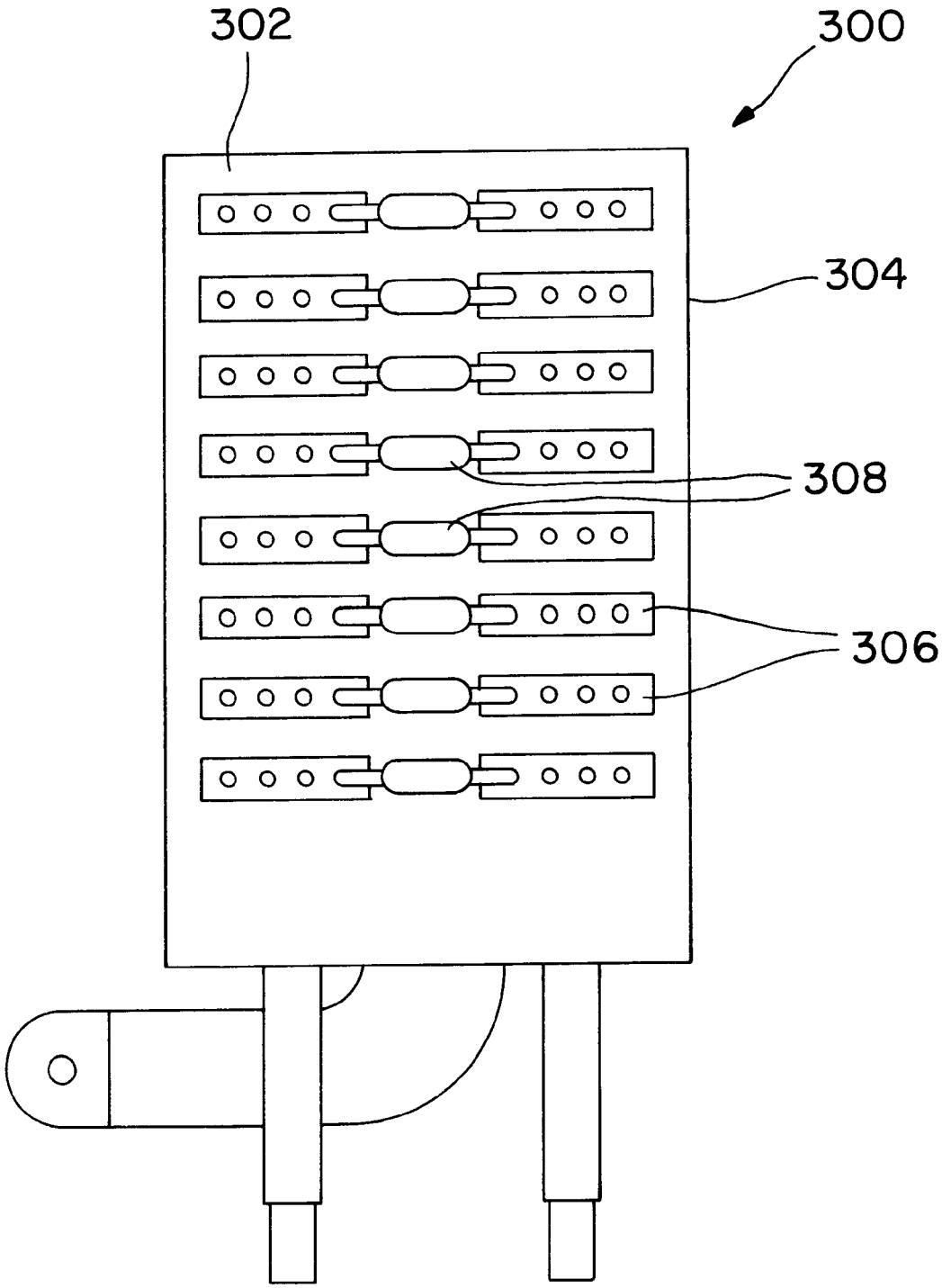
FIG. 7 is a bottom plan view of an alternative sliding switch assembly removed from the base plate.

Referring now to FIG. 7, an alternative embodiment of the sliding switch assembly is shown and generally designated 300. FIG. 7 shows the back 302 of the base plate 304. The plurality of stationary contacts 306 are connected in pairs with a series of resistors 308. These resistors 308 may increase or decrease in resistance as the sliding contacts (not shown) move from one pair of stationary contacts 306 to another pair of stationary contacts 306.

Figure 8:
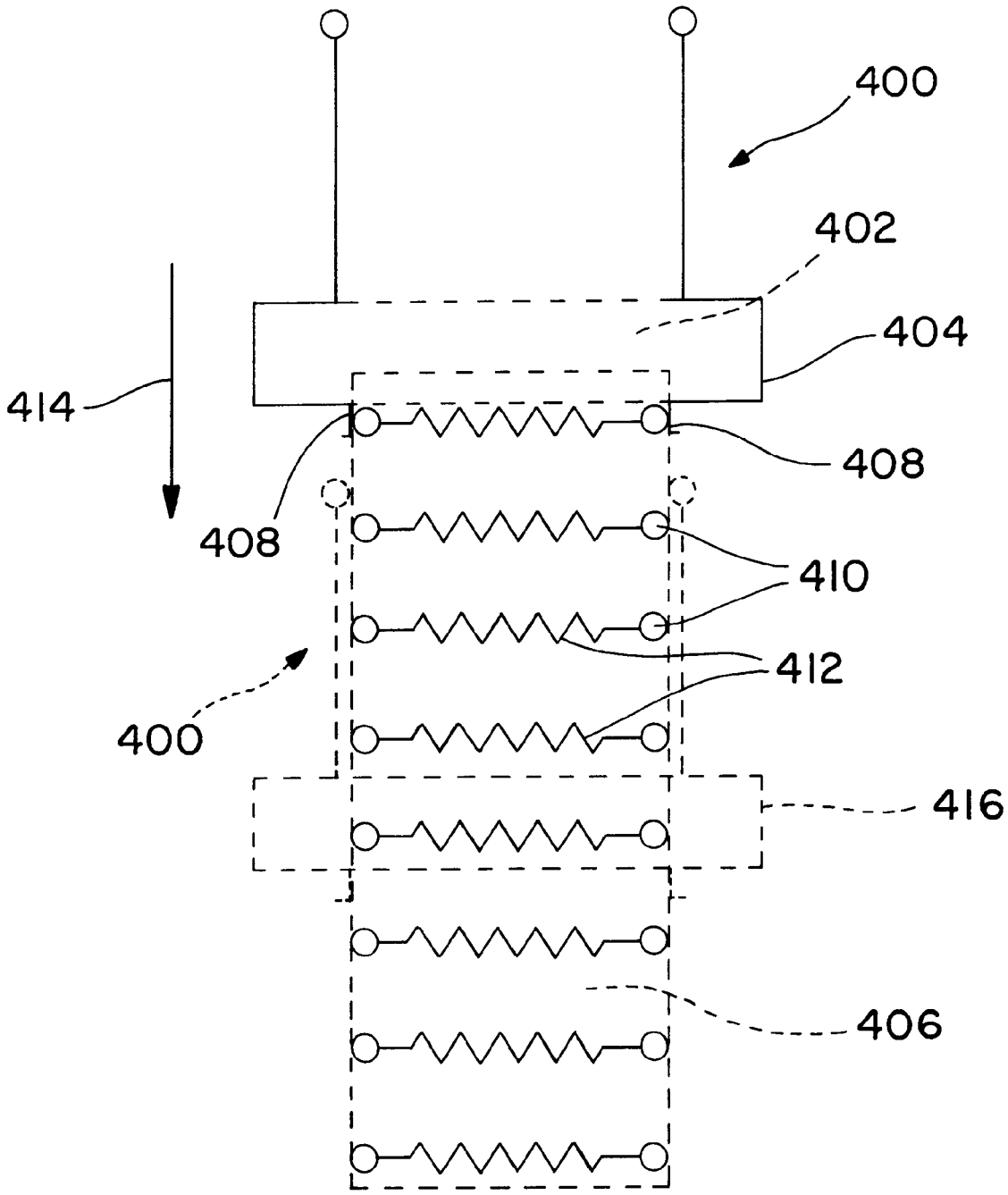
FIG. 8 is an electrical diagram representing the alternative embodiment of the sliding switch assembly.

FIG. 8 is an electrical diagram showing the circuit created by the alternative embodiment of the sliding switch assembly 300 shown in FIG. 7. This circuit is generally designated 400. When the sliding contact support arm 402 is in the first position 404 with respect to base plate 406, the sliding contacts 408 will be touching a pair of stationary contacts 410 and the circuit 400 will be closed. The circuit 400 will include a specific resistance depending on the resistor 412 installed between each pair of stationary contacts 410.

As the sliding contact support arm 402 moves in direction 414, along the base plate 406, the sliding contacts 408 will lose contact with one pair of stationary contacts 410 and then may regain contact with another pair of stationary contacts 410. On the other hand, the sliding contacts 408 may come to rest in the second position 416 where the sliding contacts 408 are not touching any stationary contacts 410, and thus, the circuit 400 will be open.

Figure 9:
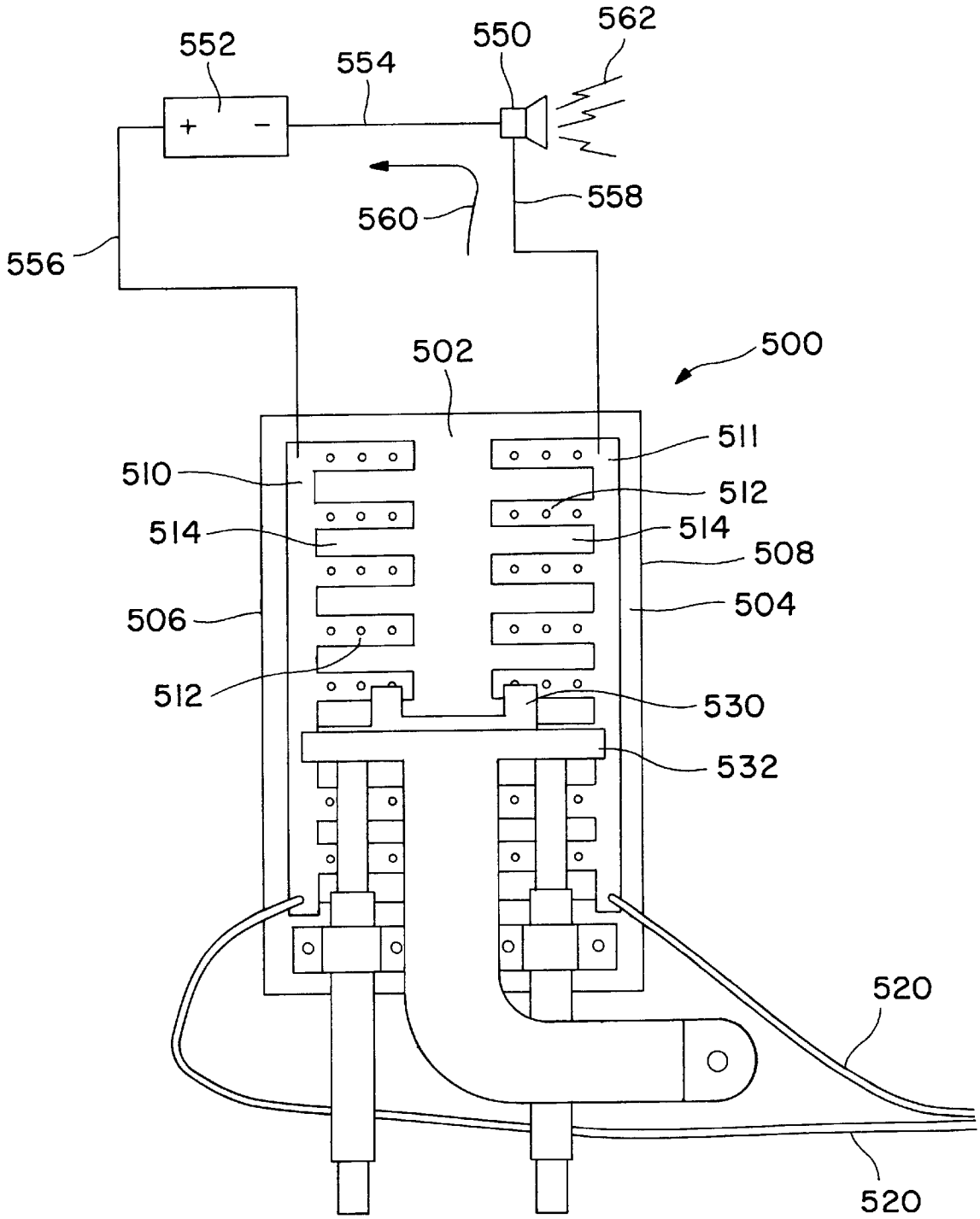
FIG. 9 is a top plan view of another alternative embodiment of the sliding switch assembly removed from the base plate.

Referring to FIG. 9, an alternative embodiment of the sliding switch assembly is shown and generally designated 500. The sliding switch assembly 500 operates in the same manner as the sliding switch assembly 170 shown in FIGS. 3 and 4. This sliding switch assembly 500 includes a base plate 502 with a front 504. The base plate 502 also includes a left edge 506 and a right edge 508.

On the front 504 of the base plate 502, along the left edge 506 and the right edge 508, are two stationary contacts 510. Each stationary contact 510 includes a plurality of arms 512 which are parallel to each other and extend inwardly along the front 504 of the base plate 502. A gap 514 is formed between each arms 512. The stationary contacts 510 are not connected to each other on the front 504 or back (not shown) of the base plate 502. A control wire 520 extends from each stationary contact 510.

The sliding switch assembly 500 includes a sliding contact 530 attached to a sliding contact support arm 532. As the sliding contact 530 moves along the front 504 of the base plate 502 intermittent contact is made with an arm 512 of each stationary contact 510. When this contact is made, the circuit formed by the stationary contacts 510 and the signal wires 520 is completed by the sliding contact 530.

An important benefit of the embodiment of the present invention shown in FIG. 9 is that the signal wires 520 are permanently mounted to the stationary contacts 510 and 511, thus eliminating any movement experienced by the wires 520 during the operation of the device. Moreover, since sliding contact 530 has no wire connections and provides the electrical circuit between contacts 510, there is little likelihood that a circuit break will occur in the electrical circuit passing through wires 520, contacts 510, and sliding contact 530.

In addition to being used as an alarm system component, the Pressure Sensitive Alarm Component of the present invention may be used in a stand-alone mode wherein the component is equipped with an audible signal generator 550, such as a piezoelectric transducer, which is in electrical connection with an internal battery 552. More specifically, audible signal generator 550 is connected via wire 554 to the negative terminal of battery 552, and the positive terminal of battery 552 is connected via wire 556 to contact 510. Contact 511 is connected via wire 558 to the positive input to audible signal generator 550. In use, when sliding contact 530 extends between arms 512, an electrical connection is made between wires 556 and 558, thereby completing the circuit allowing current to flow in direction 560 and sounding audible signal generator 550 as shown by reference numeral 562. On the other hand, when the sliding contacts 530 are in gap 514, no electrical connection is made and the circuit is open, resulting in no sound being emitted by audible signal generator 550.

In use, the Pressure Sensitive Alarm Component of the present invention may be loaded with merchandise to be monitored. Once fully loaded, the device may be adjusted to position the sliding contact 530 in gap 514. Then, if any of the merchandise is removed from the Pressure Sensitive Alarm Component of the present invention, the audible signal generator will immediately sound a warning that the monitored merchandise is being removed.

OPERATION OF A PREFERRED EMBODIMENT

Operation of a preferred embodiment of the invention includes placing the protected object on the pressure plate 102 so that the weight of the object is distributed as evenly as possible along the pressure plate 102. The weight of the object will be transmitted to the load transfer arm 156 via the pressure plate truss assemblies 140 and the load plate 152. As the load transfer arm 156 moves under the weight of the object to be protected, the sliding contact support arm 178 will move in unison with the load transfer arm 156.

As the sliding contact support arm 178 moves along the circuit board 172, the sliding contacts 176 will come in and out of contact with the stationary contacts 174. Depending on the weight of the object to be protected, the sliding contacts 176 may stop along the circuit board 172 in contact with a pair of stationary contacts 174, which is shown in FIG. 6 as the first position 204. On the other hand, the sliding contacts 176 may stop along the circuit board 172 not in contact with a pair of stationary contacts 174, which is shown in FIG. 6 as the second position 216.

To move the sliding contacts 176 so that they come into contact with the stationary contacts 174, the user may rotate the dial 162 to adjust the height of the load plate 152, which, in turn, adjusts the position of the load transfer arm 156 and the sliding contact support arm 178. When contact has been achieved between the sliding contacts 176 and a pair of stationary contacts 174, the LED 198 will light up indicating that contact has indeed been achieved.

Once contact has been achieved, the alarm may be activated. If the protected object is removed from the Pressure Sensitive Alarm Component 100, the alarm may be sounded. If a group of valuables are stacked in boxes on top of the Pressure Sensitive Alarm Component 100, the location of the sliding contact support arm 170 along the base plate may be easily adjusted to account for incremental reductions in weight as the boxes are removed by adjusting the dial 162.

While the particular Pressure Sensitive Alarm Component as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A pressure sensitive alarm component, comprising:

a base plate;

an L-shaped load plate having a first side substantially parallel to said base plate and a second side substantially perpendicular to said first side and adjacent thereto and forming a junction;

a means for mounting said L-shaped load plate to said base plate wherein urging said first side of said load plate towards said base plate causes said load plate to rotate about said junction;

a load transfer arm in mechanical contact with said second side of said load plate wherein rotation of said L-shaped load plate about said junction moves said load transfer arm in a path substantially parallel to said base plate;

a circuit board formed with a plurality of pairs of stationary contacts, each said contact of each said pair of stationary contacts being in electrical connection and separated by a distance, and each said pair of stationary contacts separated from adjacent stationary contacts by a gap;

a sliding contact support arm having a first contact and a second contact, said first contact and said second contact being separated by approximately said distance, said sliding contact support arm attached to said load transfer arm; and wherein urging said first side of said load plate towards or away from said base plate moves said first sliding contact and said second sliding contact from a first position wherein said first sliding contact and said second sliding contact are in electrical connection with a pair of said plurality of pairs of stationary contacts to make an electrical connection therebetween, to a second position within said gap where there is no electrical connection between said first sliding contact and said second sliding contact.

2. The pressure sensitive alarm component of claim 1, further comprising a pressure plate, said pressure plate positioned adjacent to said first side of said L-shaped load plate and sized to support items to be monitored.

3. The pressure sensitive alarm component of claim 2, further comprising a means for electrically connecting said first contact and said second contact to an alarm system, wherein placement of a particular weight on said pressure plate positions said first contact and said second contact in electrical contact with one pair of said plurality of pairs of stationary contacts and provides a closed circuit to said alarm system, and wherein change of said particular weight moves said first contact and said second contact into said gap and not in electrical contact with said stationary contacts and provides an open circuit to said alarm system.

4. The pressure sensitive alarm component of claim 2, further comprising a means for electrically connecting said first contact and said second contact to an alarm system, wherein placement of a particular weight on said pressure plate positions said first contact and said second contact into said gap and not in electrical contact with said stationary contacts and provides an open circuit to said alarm system, and wherein change of said particular weight moves said first contact and said second contact into electrical contact with one pair of said plurality of pairs of stationary contacts and provides a closed circuit to said alarm system.

5. The pressure sensitive alarm component of claim 1, further comprising a means for adjusting the position of said load transfer arm between a first position where said first sliding contact and said second sliding contact are in electrical connection with a pair of said plurality of pairs of stationary contacts to make an electrical connection therebetween, to a second position within said gap where there is no electrical connection between said first sliding contact and said second sliding contact.

6. The pressure sensitive alarm component of claim 5 wherein said means for adjusting the position of said load transfer arm further comprises a dial attached to a threaded post threaded into said base plate, said threaded post being in mechanical contact with said L-shaped load plate, and wherein rotating said dial in one direction raises said first side of said L-shaped load plate thereby pulling said load transfer arm towards said load plate, and rotating said dial in an opposite direction lowers said first side of said L-shaped load plate thereby pushing said load transfer arm away from said load plate.

7. The pressure sensitive alarm component of claim 1, further comprising a means for adjusting the position of said load transfer arm between a first position where said first sliding contact and said second sliding contact are in said gap where there is no electrical connection between said first sliding contact and said second sliding contact, to a second position in electrical connection with a pair of said plurality of pairs of stationary contacts to make an electrical connection therebetween.

8. The pressure sensitive alarm component of claim 7 wherein said means for adjusting the position of said load transfer arm further comprises a dial attached to a threaded post threaded into said base plate, said threaded post being in mechanical contact with said L-shaped load plate, and wherein rotating said dial in one direction raises said first side of said L-shaped load plate thereby pulling said load transfer arm towards said load plate, and rotating said dial in an opposite direction lowers said first side of said L-shaped load plate thereby pushing said load transfer arm away from said load plate.

9. The pressure sensitive alarm component of claim 1, further comprising a visible status indicator which is in electrical connection with said electrical contacts to provide a visible indication that said first contact and said second contact are in electrical connection across one said stationary contacts of said pairs of stationary contacts.

10. The pressure sensitive alarm component of claim 9, wherein said visible status indicator is a light emitting diode (LED).

11. A pressure sensitive alarm component, comprising:

a base plate;

a load plate separated from said base plate;

a circuit board formed with a plurality of conductive contacts, each conductive contact separated from adjacent conductive contacts by a gap;

a sliding contact support arm having a first sliding contact and a second sliding contact, said sliding contact support arm positioned above said circuit board such that said first sliding contact and said second sliding contact establish an electrical connection with one conductive contact of said plurality of conductive contacts to provide an electrical connection between said first sliding contact and said second sliding contact; and a means for moving said sliding contact support arm in response to said base plate being urged toward or away from said load plate, from a position wherein said first sliding contact and said second sliding contact are in electrical connection with one said conductive contact, to a position wherein said first sliding contact and said second sliding contact are not in electrical connection with one said conductive contact.

12. The pressure sensitive alarm component of claim 11 wherein said base plate and said load plate are substantially parallel.

13. The pressure sensitive alarm component of claim 11, wherein said means for moving said sliding contact support arm further comprises:

a L-shaped load plate having a first side substantially parallel to said base plate and a second side substantially perpendicular to said first side and adjacent thereto and forming a junction;

a means for mounting said L-shaped load plate to said base plate wherein urging said first side of said load plate towards said base plate causes said load plate to rotate about said junction;

a load transfer arm in mechanical contact with said second side of said load plate wherein rotation of said L-shaped load plate about said junction moves said load transfer arm in a path substantially parallel to said base plate;

a sliding contact support arm having a first contact and a second contact, said first contact and said second contact being separated by approximately said distance, said sliding contact support arm attached to said load transfer arm; and wherein urging said first side of said load plate towards said base plate moves said first sliding contact and said second sliding contact from a first position wherein said first sliding contact and said second sliding contact are in electrical connection with a pair of said plurality of pairs of stationary contacts to make an electrical connection therebetween, to a second position within said gap where there is no electrical connection between said first sliding contact and said second sliding contact.

14. The pressure sensitive alarm component of claim 10, further comprising a pressure plate, said pressure plate positioned adjacent to said first side of said L-shaped load plate and sized to support items to be monitored.

15. A pressure sensitive alarm component, comprising:

a base plate a load plate;

a circuit board formed with a plurality of pairs of first and second contacts;

a sliding contact having a width sufficient to extend between one pair of said plurality of pairs of first and second contacts wherein said sliding contact provides an electrical connection between said first contact and said second contact when positioned on and extending therebetween; and a means for moving said sliding contact between pairs of said plurality of pairs of contacts in response to said base plate being urged toward or away from said load plate.

16. The pressure sensitive alarm component of claim 15, wherein said means for moving said sliding contact support arm further comprises:

a L-shaped load plate having a first side substantially parallel to said base plate and a second side substantially perpendicular to said first side and adjacent thereto and forming a junction;

a means for mounting said L-shaped load plate to said base plate wherein urging said first side of said load plate towards said base plate causes said load plate to rotate about said junction;

a load transfer arm in mechanical contact with said second side of said load plate wherein rotation of said L-shaped load plate about said junction moves said load transfer arm in a path substantially parallel to said base plate;

a sliding contact support arm having a first contact and a second contact, said first contact and said second contact being separated by approximately said distance, said sliding contact support arm attached to said load transfer arm; and wherein urging said first side of said load plate towards or away from said base plate moves said first sliding contact and said second sliding contact from a first position wherein said first sliding contact and said second sliding contact are in electrical connection with a pair of said plurality of pairs of stationary contacts to make an electrical connection therebetween, to a second position within said gap where there is no electrical connection between said first sliding contact and said second sliding contact.

17. The pressure sensitive alarm component of claim 15, further comprising a pressure plate, said pressure plate positioned adjacent to said first side of said L-shaped load plate and sized to support items to be monitored.

18. The pressure sensitive alarm component of claim 15, further comprising a means for adjusting the position of said load transfer arm between a first position where said first sliding contact and said second sliding contact are in electrical connection with a pair of said plurality of pairs of stationary contacts to make an electrical connection therebetween, to a second position within said gap where there is no electrical connection between said first sliding contact and said second sliding contact.

19. The pressure sensitive alarm component of claim 18 wherein said means for adjusting the position of said load transfer arm further comprises a dial attached to a threaded post threaded into said base plate, said threaded post being in mechanical contact with said L-shaped load plate, and wherein rotating said dial in one direction raises said first side of said L-shaped load plate thereby pulling said load transfer arm towards said load plate, and rotating said dial in an opposite direction lowers said first side of said L-shaped load plate thereby pushing said load transfer arm away from said load plate.

20. The pressure sensitive alarm component of claim 15, further comprising a visible status indicator which is in electrical connection with said electrical contacts to provide a visible indication that said first contact and said second contact are in electrical connection across one said stationary contacts of said pairs of stationary contacts.

* * * * *